US008348616B2

(12) United States Patent
Williams et al.

(10) Patent No.: US 8,348,616 B2
(45) Date of Patent: Jan. 8, 2013

(54) TRAPPED SPRING BALANCE WEIGHT AND ROTOR ASSEMBLY

(75) Inventors: Aaron Todd Williams, West Chester, OH (US); Robert Patrick Tameo, Peabody, MA (US); Charles Eric Lavender, Mason, OH (US); Michael A. Thomas, Villa Hills, KY (US)

(73) Assignee: General Electric Company, Schenectady, NY (US)

( * ) Notice: Subject to any disclaimer, the term of this patent is extended or adjusted under 35 U.S.C. 154(b) by 1164 days.

(21) Appl. No.: 12/485,122

(22) Filed: Jun. 16, 2009

(65) Prior Publication Data

US 2010/0316496 A1 Dec. 16, 2010

(51) Int. Cl.
*F01D 25/00* (2006.01)

(52) U.S. Cl. ..... 416/144; 416/119

(58) Field of Classification Search ..... 416/119, 416/201 R, 221, 144, 145, 146 R, 500
See application file for complete search history.

(56) References Cited

U.S. PATENT DOCUMENTS

| | | | | |
|---|---|---|---|---|
| 3,965,382 | A | 6/1976 | McCrosky et al. | |
| 4,101,245 | A * | 7/1978 | Hess et al. | 416/221 |
| 4,294,135 | A | 10/1981 | Tameo | |
| 4,567,649 | A | 2/1986 | Ades et al. | |
| 4,570,053 | A | 2/1986 | Ades et al. | |
| 4,590,653 | A | 5/1986 | Ades et al. | |
| 4,635,336 | A | 1/1987 | Ades et al. | |
| 4,817,455 | A * | 4/1989 | Buxe | 415/119 |
| 4,848,182 | A * | 7/1989 | Novotny | 416/144 |
| 5,018,943 | A | 5/1991 | Corsmeier et al. | |
| 5,205,189 | A | 4/1993 | Wesling et al. | |
| 5,280,736 | A | 1/1994 | Wesling et al. | |
| 5,582,077 | A * | 12/1996 | Agram et al. | 416/144 |
| 6,279,420 | B1 | 8/2001 | Knorowski et al. | |
| 6,477,916 | B2 | 11/2002 | Knorowski et al. | |
| 6,481,969 | B2 | 11/2002 | Berry et al. | |
| 6,588,298 | B2 * | 7/2003 | Czerniak et al. | 416/145 |
| 7,234,916 | B2 | 6/2007 | Lee et al. | |
| 7,371,042 | B2 | 5/2008 | Lee | |
| 7,377,749 | B2 * | 5/2008 | Charrier et al. | 416/119 |
| 7,465,146 | B2 | 12/2008 | Kennedy et al. | |
| 2009/0133494 | A1 | 5/2009 | Van Dam et al. | |

OTHER PUBLICATIONS

PCT Search Report and Written Opinion issued Jun. 6, 2011 in connection with corresponding Application No. PCT/US2010/028403.

* cited by examiner

*Primary Examiner* — Edward Look
*Assistant Examiner* — Adam Benson
(74) *Attorney, Agent, or Firm* — General Electric Company; David J. Clement; William S. Andes

(57) ABSTRACT

A balance weight for a turbine rotor includes: (a) a block-like centerbody; (b) a pair of resilient spring arms extending laterally from opposite sides of the centerbody, the centerbody and the spring arms collectively defining an arcuate shape; and (c) at least one locating structure extending from a radially outer surface of the balance weight.

17 Claims, 9 Drawing Sheets

TRAPPED SPRING BALANCE WEIGHT AND ROTOR ASSEMBLY

STATEMENT REGARDING FEDERALLY SPONSORED RESEARCH AND DEVELOPMENT

The U.S. Government may have certain rights in this invention pursuant to contract number N00019-06-C-0081 awarded by the Department of the Navy.

BACKGROUND OF THE INVENTION

This invention relates generally to rotating machinery and more particularly to apparatus for balancing rotors.

Gas turbine engines typically include several rotor stages, each having a rotor disk carrying an array of airfoils, i.e., compressor or turbine blades. Turbine rotors must be balanced to prevent damage and excessive loads on bearings and supporting structures, as well as efficiency losses caused by loss of clearance between the airfoils and the surrounding structure (caused by, e.g., shroud rubs).

Despite efforts to first balance their constituent components, turbine rotors still require dynamic balancing following assembly. For this purpose, it is desirable to use balance weights that can be re-positioned to redistribute the mass of the rotor as needed and allow the system unbalance to be fine-tuned to meet precise requirements. Separable balance weights are a common practice in larger gas turbine engines. These include bolts, washers, nuts and other fasteners of varying sizes.

In some gas turbine rotors, notably those in smaller engines, CURVIC couplings and friction joints are assembled using a single bolt or a group of bolts (referred to as a "tie rod" or "tie bolts") spanning the length of the assembly. A tie bolt configuration weighs less than a conventional bolted joint, but the absence of bolt holes eliminates convenient features on the rotor disk which could otherwise be used to attach separable balance weights. Accordingly, the current state of the art for smaller turbine engines is to balance the assembly by selectively machining a sacrificial surface on the rotating part. Material is removed at the location of peak unbalance to redistribute the mass of the rotor about the axis of rotation. This process is irreversible and risks damaging a component such as an integrally-bladed rotor or "blisk", which is both safety-critical and expensive.

BRIEF SUMMARY OF THE INVENTION

These and other shortcomings of the prior art are addressed by the present invention, which provides a trapped spring balance weight for a turbine rotor.

According to one aspect of the invention, a balance weight for a turbine rotor includes: (a) a block-like centerbody; (b) a pair of resilient spring arms extending laterally from opposite sides of the centerbody, the centerbody and the spring arms collectively defining an arcuate shape; and (c) at least one locating structure extending from a radially outer surface of the balance weight.

According to another aspect of the invention a turbine rotor assembly includes: (a) a rotor element including an annular first hub surface and an annular first flange surrounding the first hub surface, spaced away from the first hub surface so as to define a first pocket; and (b) at least one balance weight disposed in the first pocket, including: (i) a block-like centerbody; (ii) a pair of resilient spring arms extending laterally from opposite sides of the centerbody, the centerbody and the spring arms collectively defining an arcuate shape; and (iii) at least one locating feature extending radially outward from the balance weight. The spring arms and the centerbody resiliently bear against the first flange and the first hub surface, respectively, so as to retain the balance weight in the first pocket.

BRIEF DESCRIPTION OF THE DRAWINGS

The invention may be best understood by reference to the following description taken in conjunction with the accompanying drawing figures in which.

DETAILED DESCRIPTION OF THE INVENTION

Figure 1:
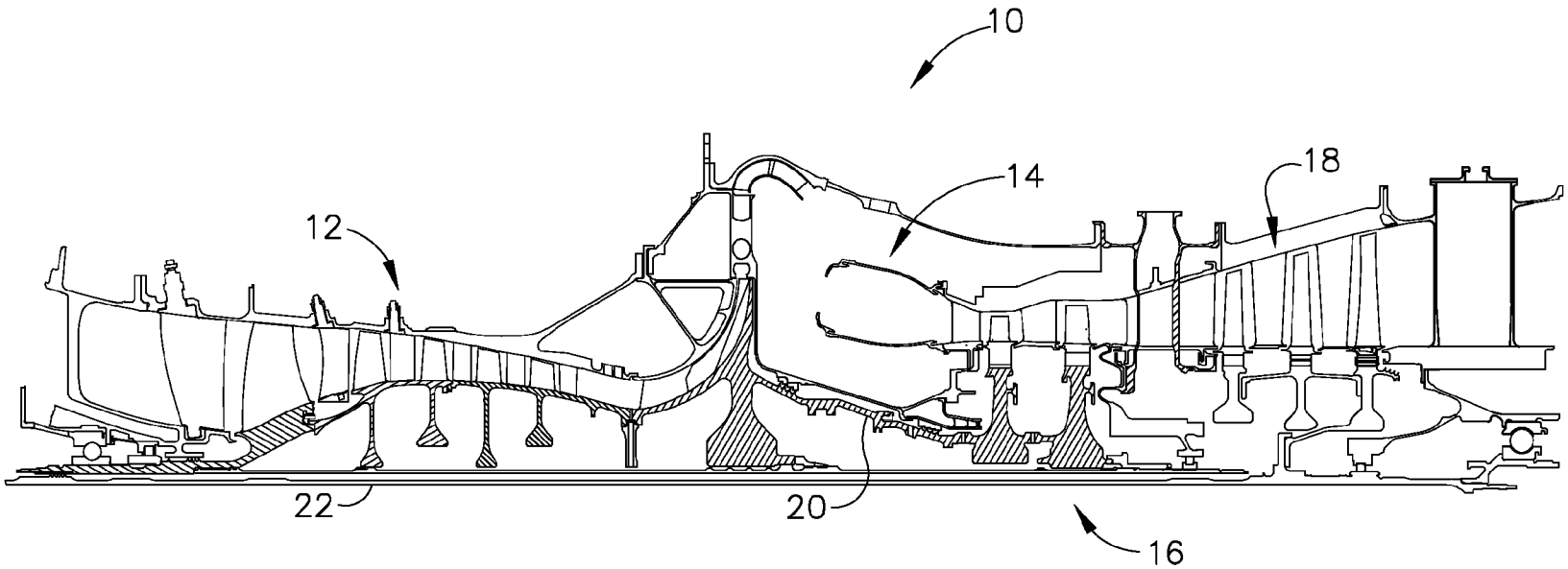
FIG. 1 is a cross-sectional view of a gas turbine engine constructed in accordance with an aspect of the present invention.

Referring to the drawings wherein identical reference numerals denote the same elements throughout the various views, FIG. 1 depicts an exemplary gas turbine engine 10 having a compressor 12, a combustor 14, a high pressure or gas generator turbine 16, and a work turbine 18, all arranged in a serial flow relationship. Collectively the compressor 12, the combustor 14, and the gas generator turbine 16 are referred to as a "core". The compressor 12 provides compressed air that passes into the combustor 14 where fuel is introduced and burned, generating hot combustion gases. The hot combustion gases are discharged to the gas generator turbine 16 where they are expanded to extract energy therefrom. The gas generator turbine 16 drives the compressor 12 through an impeller shaft 20. Pressurized air exiting from the gas generator turbine 16 is discharged to the work turbine 18 where it is further expanded to extract energy. The work turbine 18 drives an inner shaft 22.

In the illustrated example, the engine is a turboshaft engine, and the inner shaft 22 would be coupled to an external load such as a reduction gearbox or propeller. However, the principles described herein are equally applicable to turboprop, turbojet, and turbofan engines, as well as turbine engines used for other vehicles or in stationary applications. These principles are also applicable to any other type of rotating machinery (e.g. wheels, gears, shafts, etc.) which require balancing.

Figure 2:
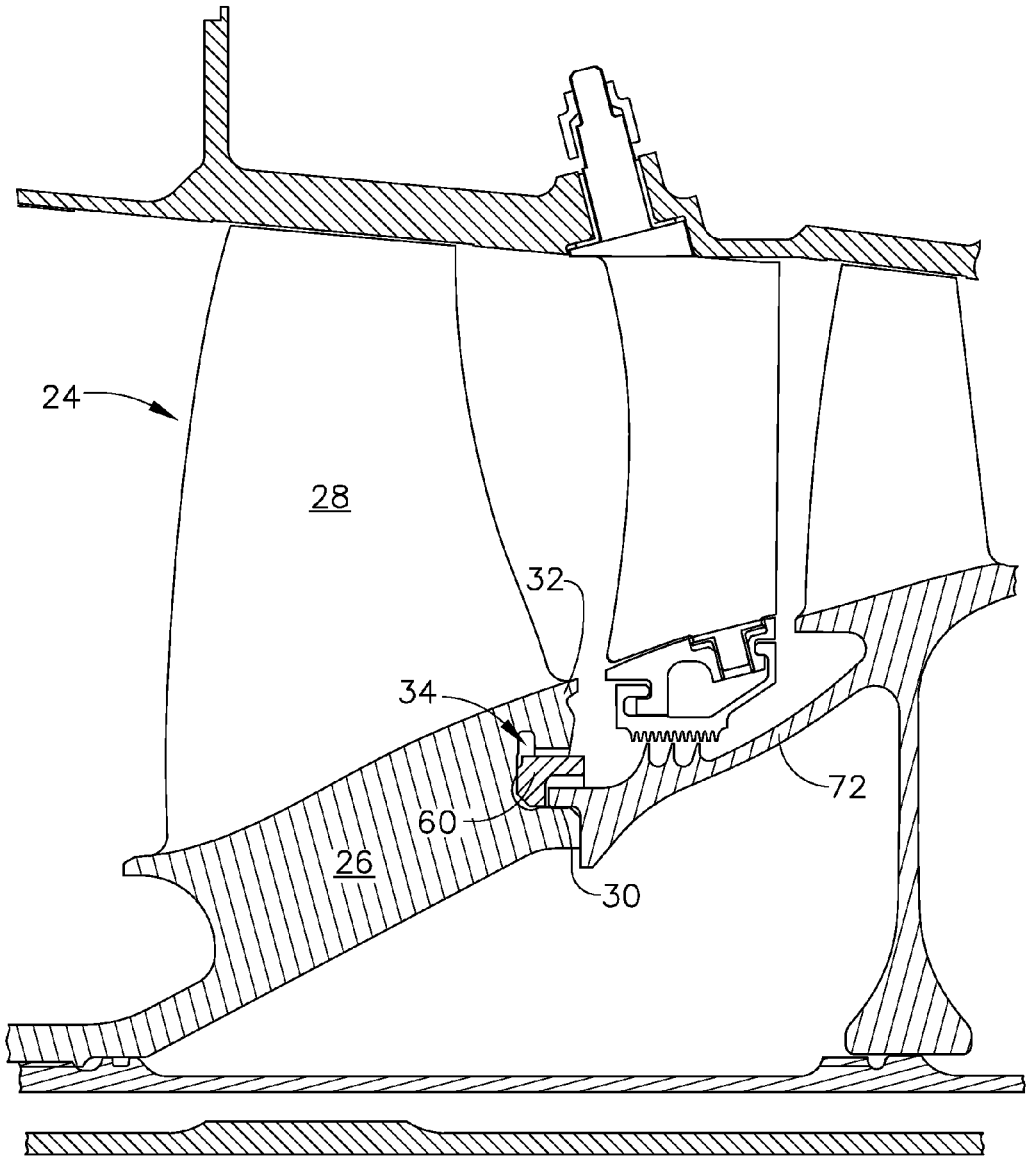
FIG. 2 is an enlarged view of the forward portion of the compressor of the engine shown in FIG. 1.

In the illustrated example, the compressor 12 includes five axial-flow rotor stages and one mixed-flow stage which is positioned immediately upstream of the combustor 14. As best seen in FIG. 2, the first stage rotor 24 of the compressor 12 is an integrally-bladed rotor or "blisk" in which a rotor disk 26 and a plurality of airfoil-shaped compressor blades 28 are formed as one integral component. The aft end of the rotor disk 26 includes an annular hub surface 30 and an annular flange 32 extending over the hub surface 30. Together, the hub surface 30 and the flange 32 define a pocket 34 (best seen in FIG. 6). An inner surface 36 of the flange 32 has an array of grooves 38 formed therein (again, see FIG. 6).

Figure 3:
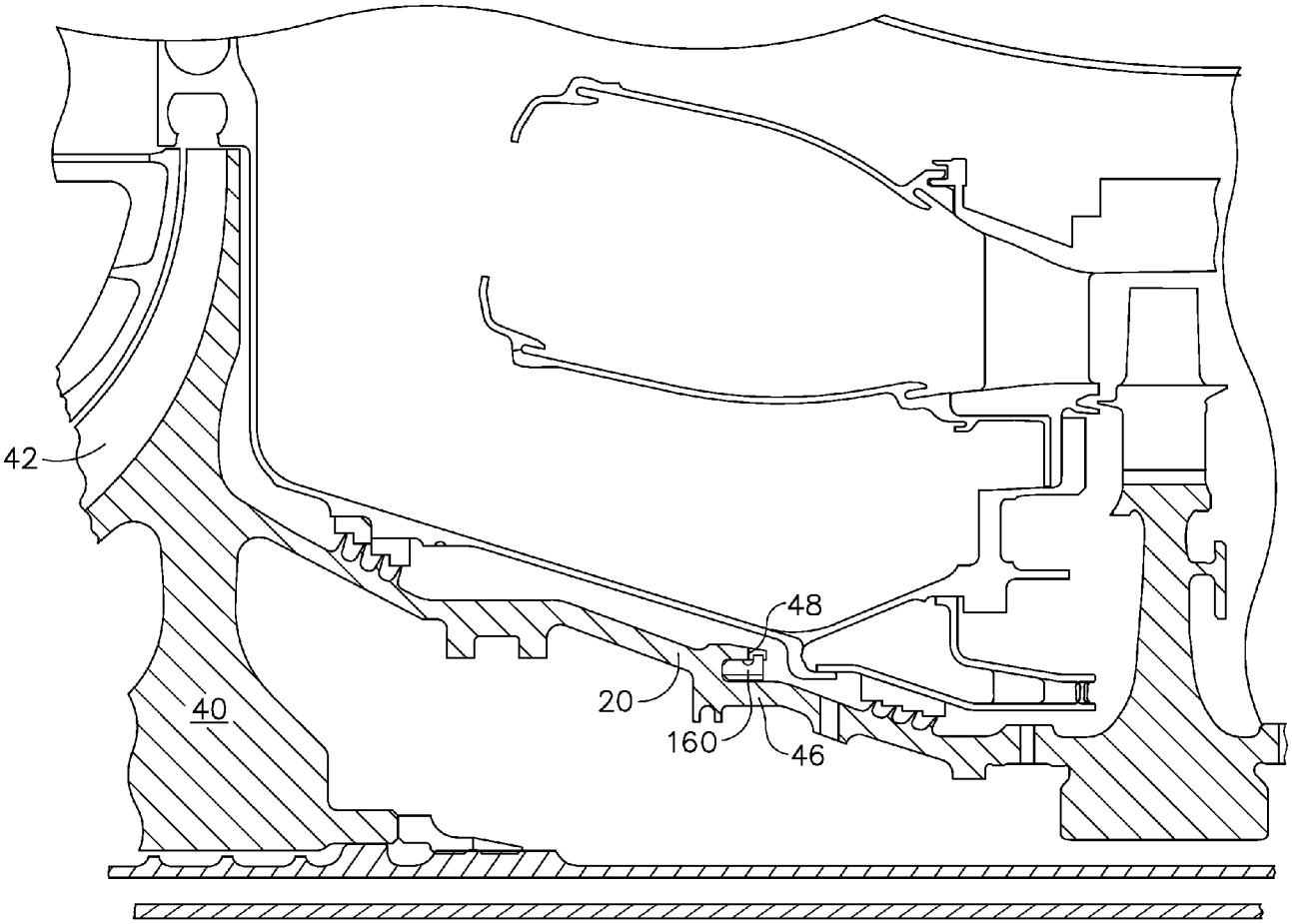
FIG. 3 is an enlarged view of the aft portion of the compressor of the engine shown in FIG. 1.
Figure 13:
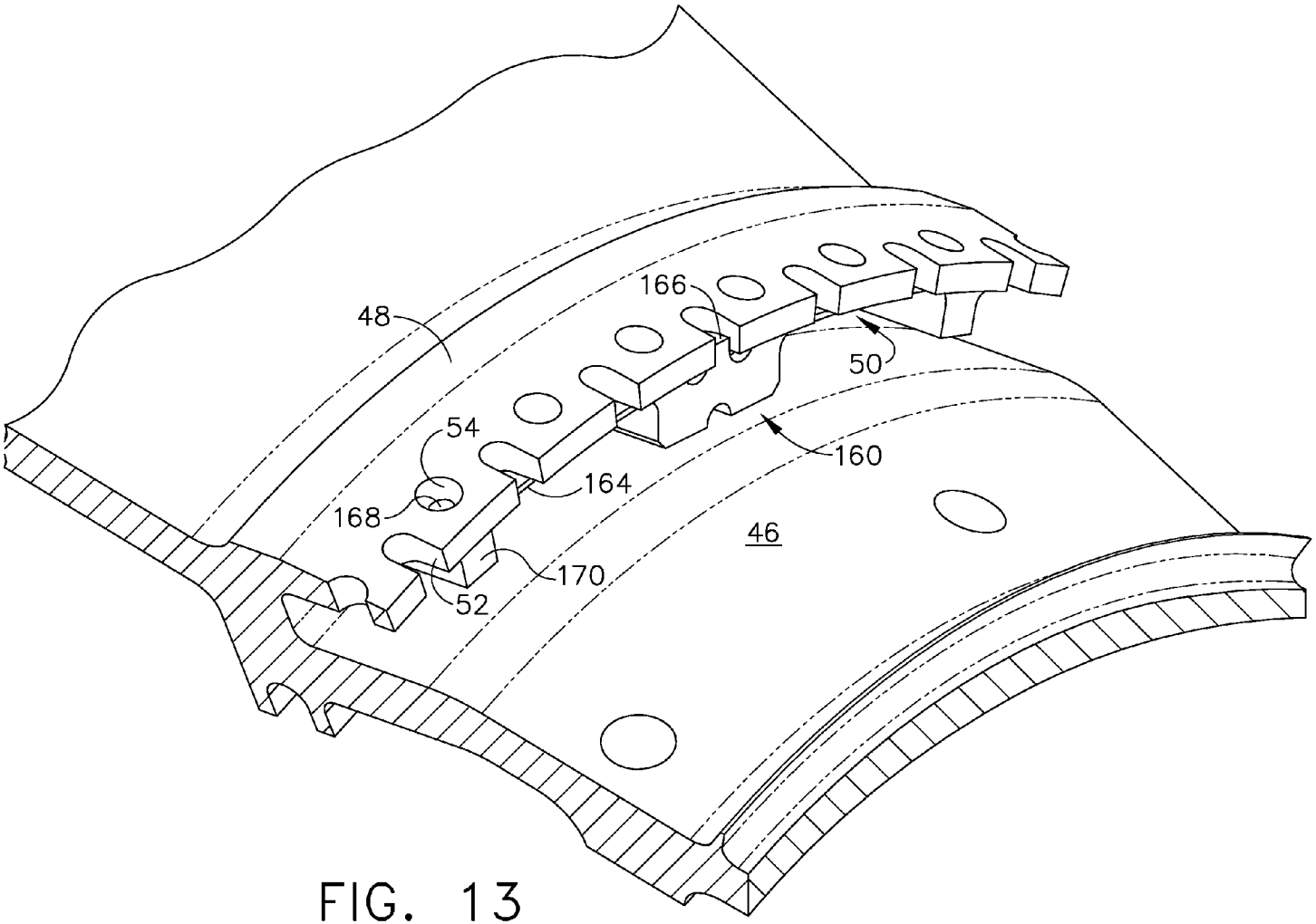
FIG. 13 is a perspective view of the balance weight of FIG. 11 installed in the engine of FIG. 1.

As seen in FIG. 3, the final stage of the compressor 12 includes a rotor disk 40 which carries a plurality of blades 42. The annular impeller shaft 20 extends axially aft from the rotor disk 40. The intermediate section of the impeller shaft 20 includes an annular hub surface 46 and an annular flange 48 extending over the hub surface 46. Together, the hub surface 46 and the flange 48 define a pocket 50 (best seen in FIG. 13). The flange 48 includes an annular array of apertures formed therein. In the illustrated example, as seen in FIG. 13, this array comprises open-ended slots 52 alternating with holes 54.

One or more forward balance weights 60 are installed in the pocket 34 of the first stage rotor 24, and one or more aft balance weights 160 are installed in the pocket 50 of the impeller shaft 20. The exact number, position, and distribution of weights will vary by individual engine. In the particular engine illustrated, only two balance weights are used. Correction of rotor imbalance is accomplished by re-positioning the weights as needed.

Figure 4:
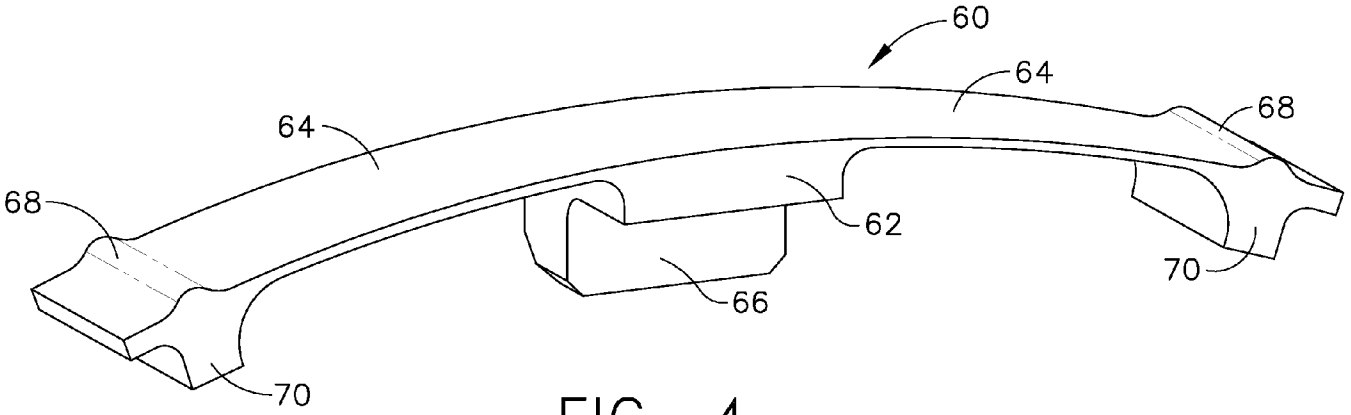
FIG. 4 is a perspective view of a balance weight constructed according to an aspect of the present invention.
Figure 5:
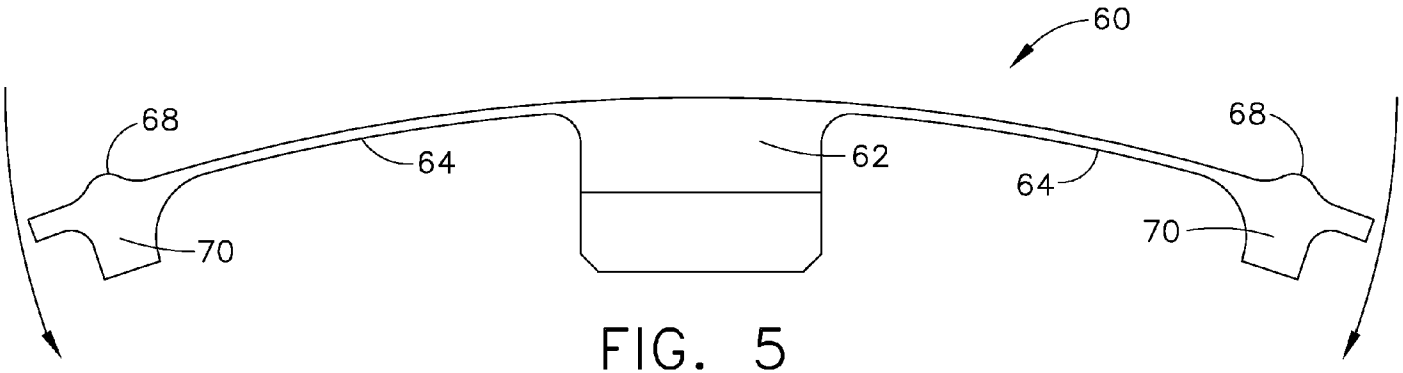
FIG. 5 is a rear elevational view of the balance weight of FIG. 4.

FIGS. 4 and 5 illustrate one of the forward balance weights 60 in more detail. It is generally arcuate in shape and comprises a block-like centerbody 62 with resilient spring arms 64 extending laterally outward therefrom. A notch 66 is formed in the radially inner end of the centerbody 62. At the distal end of each spring arm 64, an axially-elongated rail 68 extends radially outward. Opposite each rail 68, a stop block 70 extends radially inward. The forward balance weights 60 may be constructed from any material with an appropriate density and the ability to form the spring arms which can deflect elastically. For example, metal alloys may be used.

Figure 6:
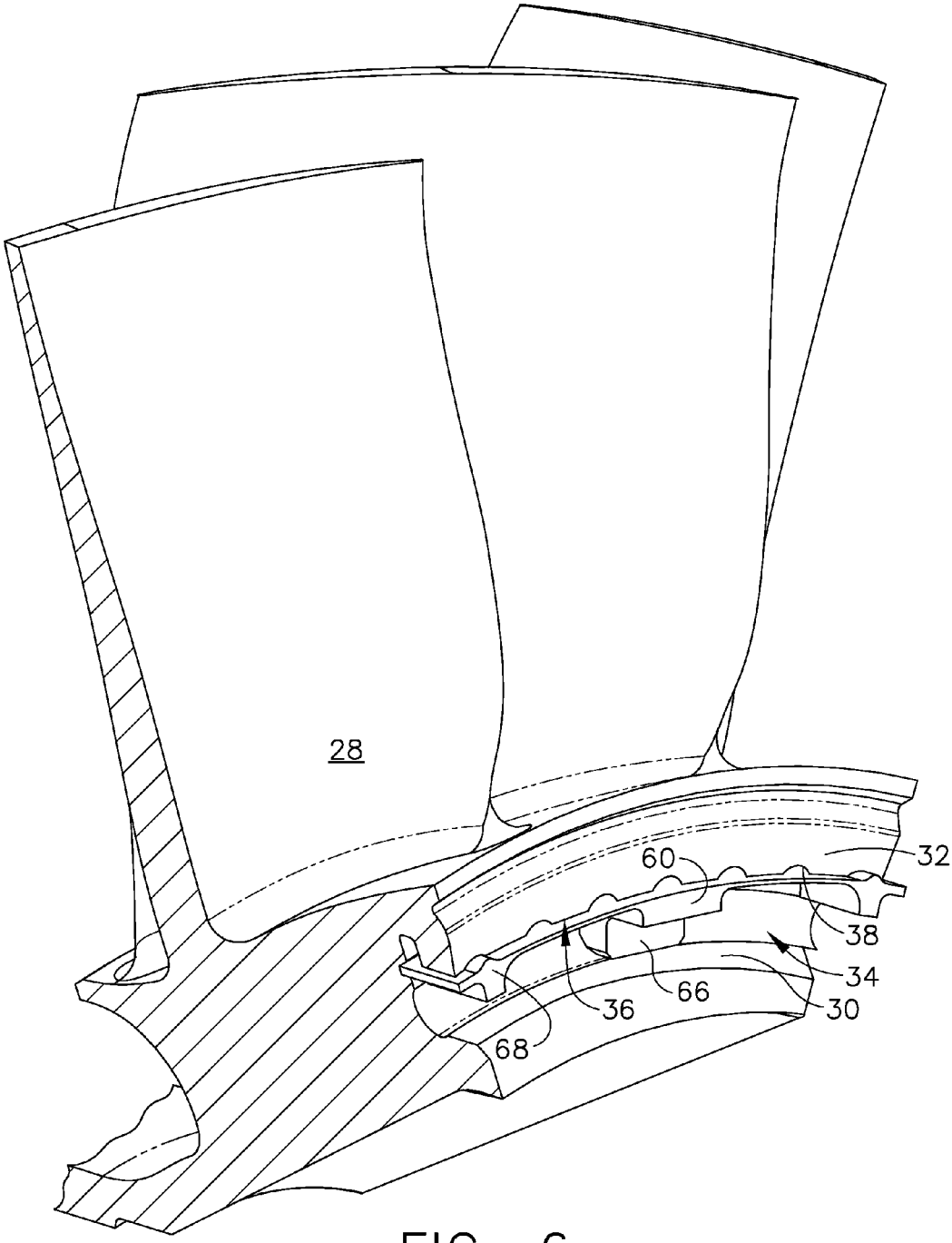
FIG. 6 is a perspective view of the balance weight of FIG. 4 installed in a rotor disk of the engine of FIG. 1.

With reference to FIG. 6, the forward balance weights 60 are installed into the first stage rotor 24 as follows. The spring arms 64 are deflected radially inward relative to the centerbody 62. They may be held in this position by an appropriate tool or jig. Then the forward balance weight 60 is slid axially into the pocket 34, at the appropriate position. The spring arms 64 are then released. After release, the residual spring force urges the spring arms 64 radially outward against the flange 32 and urges the centerbody 62 against the hub surface 30. The rails 68 engage the grooves 38 in the inner surface of the flange 32 to prevent tangential movement. A mating component (in this case the forward end of an annular shaft 72, seen in FIG. 2) abuts the notch 66 to prevent axial movement of the forward balance weight 60. FIG. 6 shows one of the forward balance weights 60 in an installed condition. During engine operation, centrifugal loading reseats the forward balance weights 60 against the flange 32.

Figure 9:
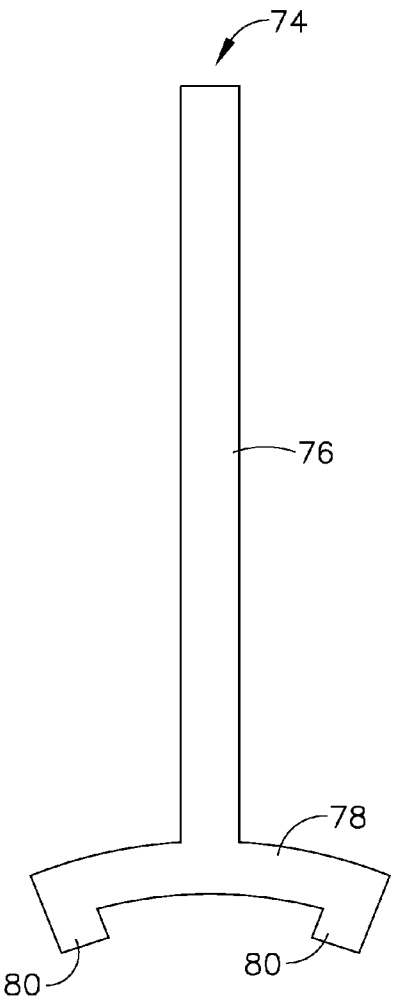
FIG. 9 is a rear view of the spanner tool of FIG. 7.
Figure 8:
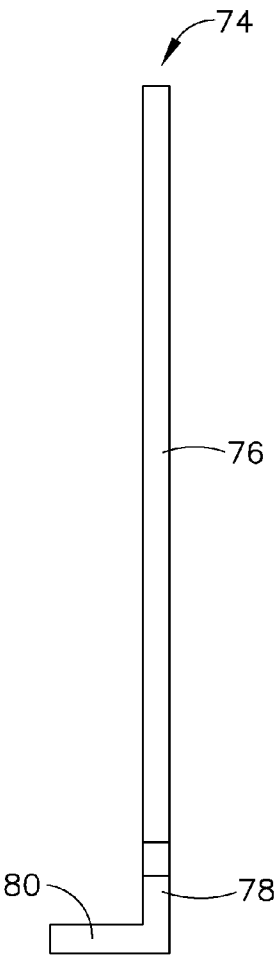
FIG. 8 is a side view of the spanner tool of FIG. 7.
Figure 7:
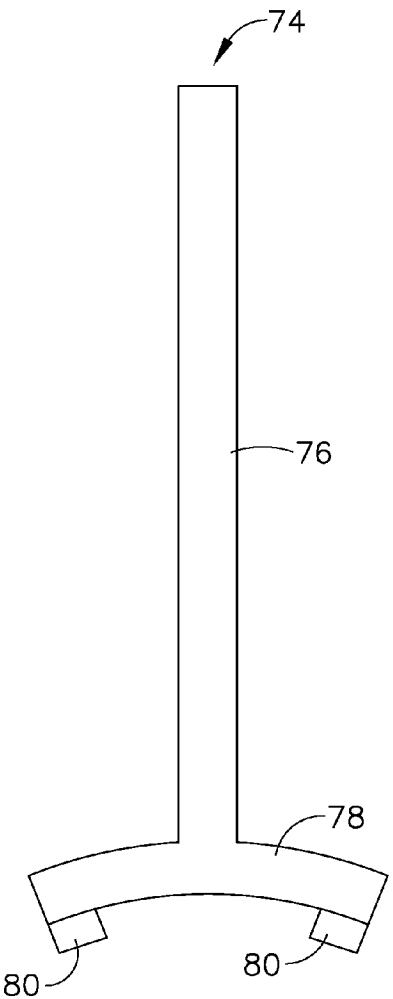
FIG. 7 is a front view of a spanner tool for use with a balance weight.
Figure 10:
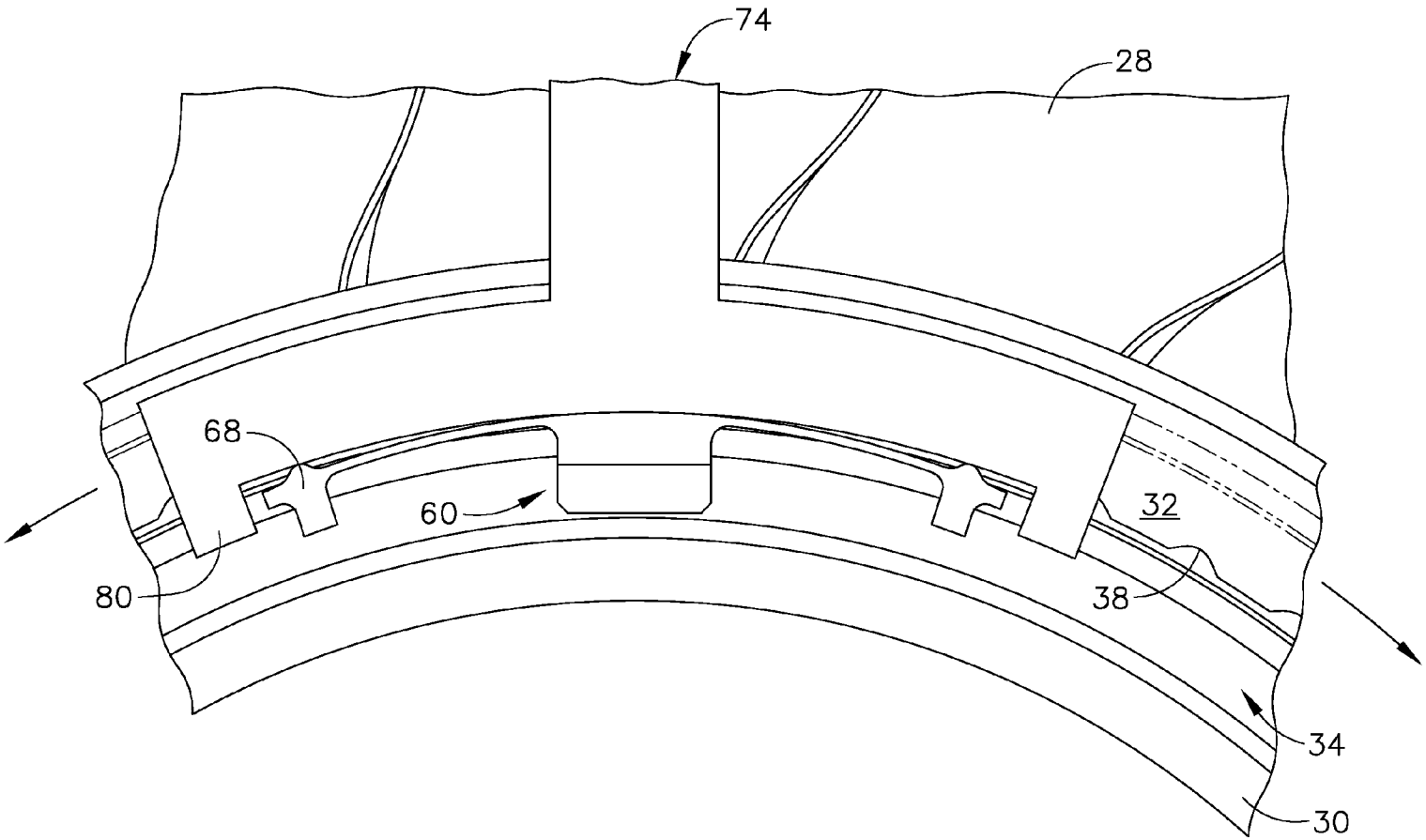
FIG. 10 is a view of the spanner tool of FIG. 7 in use.

If necessary as indicated by a balancing operation, the forward balance weights 60 can be repositioned circumferentially while the compressor 12 is assembled, for example through use of a spanner-wrench tool. For example, FIGS. 7-9 illustrate a suitable tool 74 which has an elongated handle 76 and a curved head 78 with spanner fingers 80 extending radially inward and laterally outward from its distal ends. As shown in FIG. 10, the tool 74 is inserted into the pocket 34 and used to deflect the spring arms 64 radially inward, disengaging the rails 68 from the grooves 38. The tool 74 may then be moved tangentially in the direction of the arrows, causing the spanner fingers 80 to contact the forward balance weight 60 and push it to a new position. Once the tool 74 is removed, the rails 68 re-engage grooves 38 at the new location. During this operation, the stop blocks 70 contact the annular shaft 72 if an attempt is made to deflect the spring arms 64 too far. This prevents permanent deformation of the spring arms 64.

Figure 11:
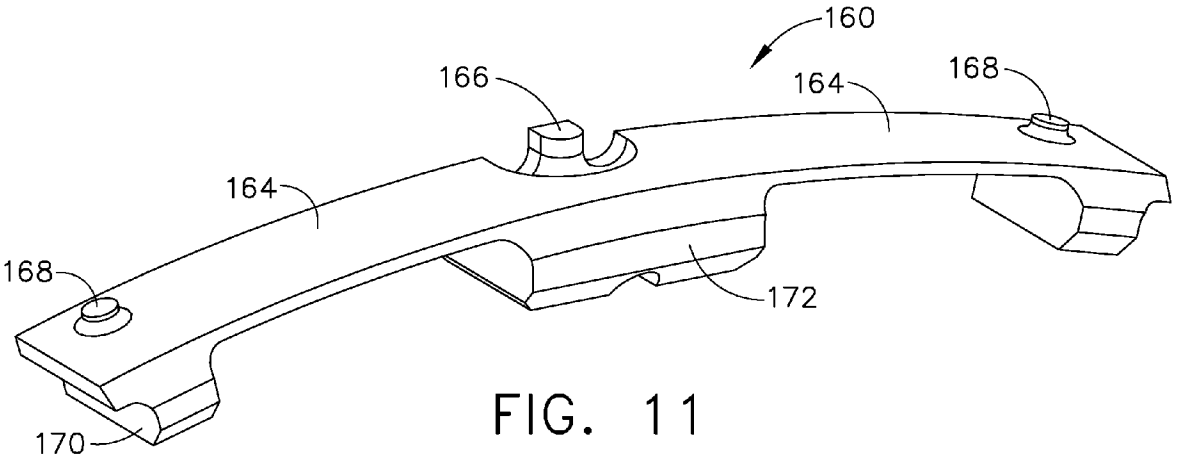
FIG. 11 is a perspective view of a balance weight constructed according to another aspect of the present invention.
Figure 12:
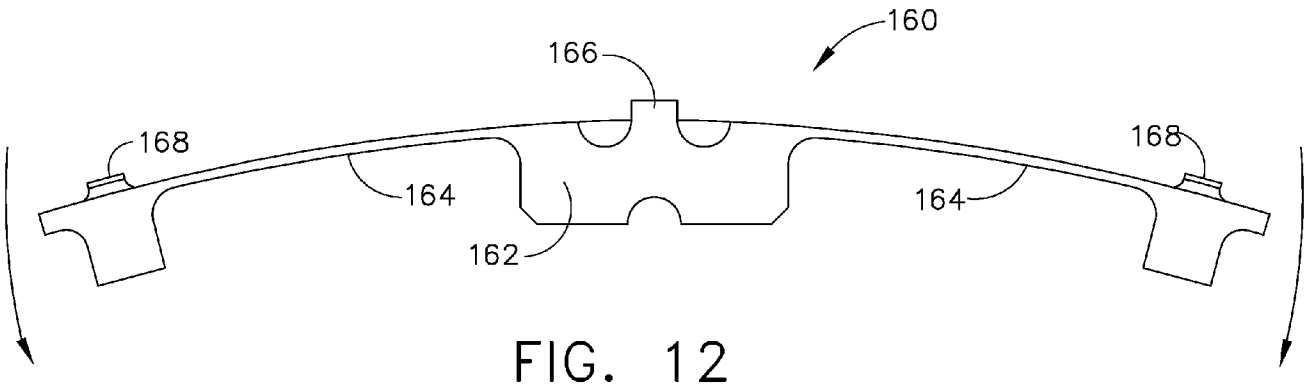
FIG. 12 is a rear elevational view of the balance weight of FIG. 11.

FIGS. 11 and 12 illustrate one of the aft balance weights 160 in more detail. It is generally arcuate in shape and comprises a block-like centerbody 162 with resilient spring arms 164 extending laterally outward therefrom. An anti-rotation lug 166 extends radially outward from the centerbody 162. At the distal end of each spring arm 164, a shear pin 168 extends radially outward. Opposite each shear pin 168, a stop block 170 extends radially inward. A forward face 172 of the aft balance weight 160 has a convex contour complementary to the cross-sectional profile of the pocket 50 in the impeller shaft 20. The aft balance weights 160 may be constructed from any material with an appropriate density and the ability to form the spring arms which can deflect elastically. For example, metal alloys may be used.

As seen in FIG. 13, the aft balance weights 160 are installed using a method similar to that for the forward balance weights 60, as follows. The spring arms 164 are deflected radially inward relative to the centerbody 162, as shown by the arrows in FIG. 12. They may be held in this position by an appropriate tool or jig. Then the aft balance weight 160 is slid axially into the pocket 50, at the appropriate position. The stop blocks 170 are sized and shaped so as to prevent insertion into the pocket 50 if the spring arms 164 are deflected too far, and thus prevent permanent deformation of the spring arms 164. The spring arms 164 are then released. After release, the residual spring force urges the spring arms 164 radially outward against the flange 48 and urges the centerbody 162 against the hub surface 46. The anti-rotation lug 166 engages one of the slots 52 in the flange 48. The shear pins 168 engage the holes 54 in the flange 48 to prevent axial movement. FIG. 13 shows one of the aft balance weights 160 in an installed condition. During engine operation, centrifugal loading reseats the aft balance weights 160 against the flange 48. If necessary, the aft balance weights 160 can be removed and re-positioned while the compressor rotor is assembled, without any unique jigs or tools.

While the balance weights 60 and 160 have described as "forward" and "aft" weights, it will be understood that these terms are used merely for convenience in description of a particular embodiment. Depending upon the specific engine application and the mating hardware, either design could be used on the forward or aft face of a turbine rotor disk or shaft. Furthermore, the anti-rotation and axial restraint features could be modified or used in different combinations to produce a balance weight suitable for a particular application.

The balance weight design described herein has several advantages over the current state-of-the-art for small engines. Process control is improved compared to material removal directly from the first stage rotor 24, which introduces local stress concentrations on highly stressed critical rotating parts. Any stress concentration features present on the balance weights 60 and 160 would be generated using precision machining techniques and are therefore more well controlled. Engine cleanliness is also enhanced, as the balance weights do not require any machining at engine assembly and therefore do not create dust or grit that could contaminate the engine system. Finally, cycle time for the balancing process is reduced, because the balance weights can be easily re-positioned while the rotor is loaded in a balance machine, eliminating the re-work loop associated with a material removal balancing process.

The foregoing has described balance weights for a turbine rotor and a balanced rotor assembly. While specific embodiments of the present invention have been described, it will be apparent to those skilled in the art that various modifications thereto can be made without departing from the spirit and scope of the invention. Accordingly, the foregoing description of the preferred embodiment of the invention and the best mode for practicing the invention are provided for the purpose of illustration only and not for the purpose of limitation, the invention being defined by the claims.

What is claimed is:

1. A balance weight for a turbine rotor, comprising:
(a) a block-like centerbody;
(b) a pair of resilient spring arms extending laterally from opposite sides of the centerbody, the centerbody and the spring arms collectively defining an arcuate shape; and
(c) at least one locating structure extending from a radially outer surface of the balance weight.

2. The balance weight of claim 1 wherein an anti-rotation lug extends radially outward from the centerbody.

3. The balance weight of claim 1 wherein a shear pin extends radially outward from a distal end of each of the spring arms.

4. The balance weight of claim 1 wherein an axially elongated rail extends radially outward from a distal end of each of the spring arms.

5. The balance weight of claim 1 wherein a stop block extends radially inward from a distal end of each of the spring arms.

6. The balance weight of claim 1 wherein the centerbody includes a notch formed at a radially inner end thereof.

7. A turbine rotor assembly, comprising:
(a) a rotor element including an annular first hub surface and an annular first flange surrounding the first hub surface, spaced away from the first hub surface so as to define a first pocket; and
(b) at least one balance weight disposed in the first pocket, comprising:
(i) a block-like centerbody;
(ii) a pair of resilient spring arms extending laterally from opposite sides of the centerbody, the centerbody and the spring arms collectively defining an arcuate shape; and
(iii) at least one locating feature extending radially outward from the balance weight;
(c) wherein the spring arms and the centerbody resiliently bear against the first flange and the first hub surface, respectively, so as to retain the balance weight in the first pocket.

8. The turbine rotor assembly of claim 7 wherein an anti-rotation lug extends radially outward from the centerbody and engages an aperture in the first flange, so as to prevent axial movement of the balance weight relative to the rotor disk.

9. The turbine rotor assembly of claim 7 wherein each of the spring arms includes a shear pin extending radially outward from a distal end thereof, the shear pins engaging apertures in the first flange.

10. The turbine rotor assembly of claim 7 wherein each of the spring arms includes an axially elongated rail extending radially outward from a distal end thereof, the rails engaging grooves in the first flange.

11. The turbine rotor assembly of claim 7 wherein a stop block extends radially inward from a distal end of each of the spring arms, the radial height of the stop blocks selected so as to prevent insertion of the balance weight into the first pocket if the spring arms are deflected beyond a predetermined limit.

12. The turbine rotor assembly of claim 7 further comprising an additional member abutting the first pocket so as to retain the balance weight in the first pocket in an axial direction.

13. The turbine rotor assembly of claim 12 wherein the centerbody includes a notch formed at a radially inner end thereof which abuts the additional member.

14. The turbine rotor assembly of claim 7, comprising:
(a) an annular member defining an annular second hub surface and an annular second flange surrounding the second hub surface, spaced away from the second hub surface so as to define a second pocket; and
(b) at least one balance weight disposed in the second pocket, comprising:
(i) a block-like centerbody;
(ii) a pair of resilient spring arms extending laterally from opposite sides of the centerbody, the centerbody and the spring arms collectively defining an arcuate shape; and
(iii) at least one locating feature extending from the balance weight;
(c) wherein the spring arms and the centerbody resiliently bear against the second flange and the second hub surface, respectively, so as to retain the balance weight in the second pocket.

15. The turbine rotor assembly of claim 14 wherein the annular member is an impeller shaft disposed in a compressor downstream of the rotor disk.

16. A method of balancing a turbine rotor assembly which includes an annular member defining an annular hub surface and an annular flange surrounding the hub surface, spaced away from the hub surface so as to define a pocket, the method comprising:
(a) inserting at least one balance weight in the pocket at an initial position, the balance weight comprising:
(i) a block-like centerbody;
(ii) a pair of resilient spring arms extending laterally from opposite sides of the centerbody, the centerbody and the spring arms collectively defining an arcuate shape; and
(iii) at least one locating feature extending from the balance weight;
(c) wherein the spring arms and the centerbody resiliently bear against the flange and the second hub surface, respectively, so as to retain the balance weight in the pocket;
(d) performing a balancing operation on the rotor assembly to determine a new position for the balance weight;
(e) inserting a tool into the pocket to disengage the balance weight from the pocket;
(f) using the tool, moving the balance weight to the new position within the pocket; and
(g) removing the tool so as to permit the spring arms and the centerbody to resiliently bear against the flange and the hub surface, respectively, so as to retain the balance weight in the pocket.

17. The method of claim 16 wherein the tool comprises:
(a) an elongated handle;
(b) a curved head disposed at an end of the handle; and
(c) a pair of spanner fingers extending laterally from distal ends of the handle.

* * * * *